US005117342A

United States Patent [19]

Vlah

[11] Patent Number: 5,117,342

[45] Date of Patent: May 26, 1992

[54] UNIVERSAL FIT LONGERON SUPPORTED LOUVER SYSTEM

[76] Inventor: John A. Vlah, 14330 Georgia Rd., Middlefield, Ohio 44062

[21] Appl. No.: 598,188

[22] Filed: Oct. 16, 1990

[51] Int. Cl.[5] ..... F21S 3/02

[52] U.S. Cl. ..... 362/217; 362/260; 362/290; 362/342

[58] Field of Search ..... 362/217, 260, 290, 291, 362/325, 342; 29/505, 513

[56] References Cited

U.S. PATENT DOCUMENTS

| | | | |
|---|---|---|---|
| 2,364,992 | 12/1944 | Maurette | 362/342 |
| 2,642,952 | 6/1953 | Landgraf | 29/513 |
| 2,667,916 | 2/1954 | Burd | 29/505 |
| 2,967,337 | 1/1991 | Hedrick | 23/513 |
| 3,050,160 | 8/1962 | Chesser | 29/513 |
| 4,407,011 | 9/1983 | Lahm | 362/290 X |
| 4,717,992 | 1/1988 | Bartenbach et al. | 362/342 X |
| 4,849,867 | 7/1989 | Glass et al. | 362/342 |

FOREIGN PATENT DOCUMENTS

| | | | |
|---|---|---|---|
| 1120849 | 4/1956 | France | 362/342 |
| 587744 | 5/1941 | United Kingdom | 362/342 |
| 664072 | 1/1952 | United Kingdom | 362/342 |

OTHER PUBLICATIONS

Xerox-copies of pages from catalog (enlarged): Zumtobel Lighting The Way/ZN Batten Luminaire System.

Xerox-copies of pages from catalog (enlarged): Fluorescent/Incandescent Lighting Classics.

*Primary Examiner*—Ira S. Lazarus

*Assistant Examiner*—Y. Quach

*Attorney, Agent, or Firm*—Watts, Hoffmann, Fisher & Heinke Co.

[57] ABSTRACT

An improved louver assembly to be used in conjunction with a strip lighting fixture is disclosed. Louver assemblies can be used in series with rows of strip lighting fixtures to form an improved louvered lighting system. The louver assembly is comprised of two longerons which are parallel to and adjacent the lighting fixture. Two brackets mounted over the lighting fixture support the longerons and align them with longerons of adjacent assemblies. A set of louvers is attached to and between opposite longerons. The set of louvers has a stringer fin running transversely through the louver centers and two side baffles running transversely along the louvers' inside corners. The assembly can be swung open easily for access to the lighting fixture.

18 Claims, 7 Drawing Sheets

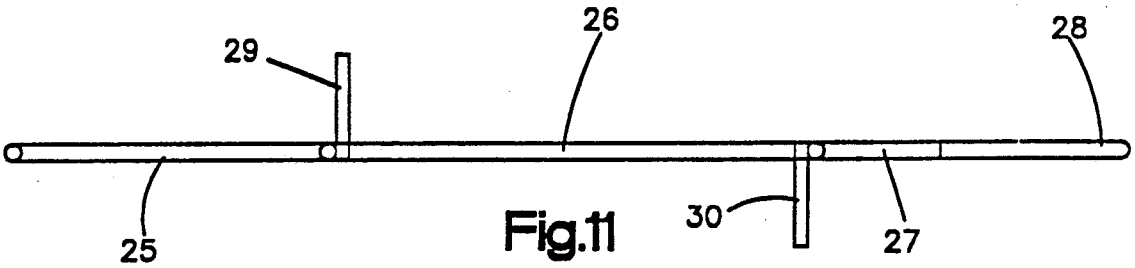
Fig.11
Fig.12
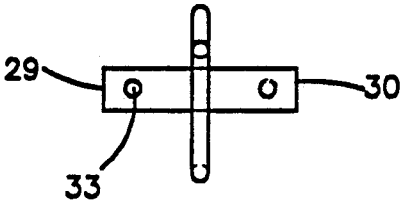
Fig.13
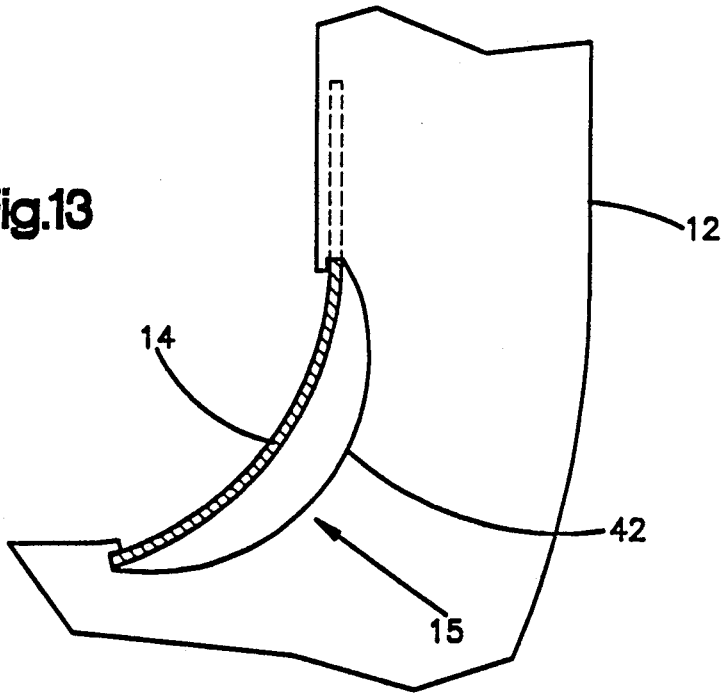

UNIVERSAL FIT LONGERON SUPPORTED LOUVER SYSTEM

TECHNICAL FIELD

This invention relates to strip lighting and more particularly to a universal fit louver system for use with strip lighting fixtures.

BACKGROUND

Lighting is a vital part of any business. Stores, offices, factories, warehouses, etc. all require some type of lighting system. Some require soft, pleasant light while others require bright light. Some require attractive lighting fixtures while others just need a basic light source.

Stores and offices generally install attractive lighting fixtures with means for softening the light in order to create an attractive, pleasant atmosphere. This can be a fairly expensive investment. Factories and warehouses generally install a basic light source as there is no need for such a large investment. Many discount stores and other mass merchandisers have installed a basic light source in order to save money. The main type of basic light source installed is strip lighting fixtures.

Strip lighting fixtures have been around for years. Strip lighting fixtures are basically long boxes supporting long, fluorescent tubes. These fixtures are placed end to end in rows to form a basic strip lighting system. Light from such a system is bright when looked at directly and the system as a whole is unattractive. With some strip lighting fixtures, the light is softened by a baffling or diffusing system that is actually part of the light fixture. Strip lighting fixtures with such systems are generally more expensive.

Today's business society is a fast paced one which is constantly changing. Domestic factories and counterparts. Ergonomics is one weapon for increasing productivity and efficiency. By creating a more pleasant atmosphere, workers will enjoy their work more and thereby produce larger quantities at a higher quality level. Discount stores also face stiff competition from major "high class" stores forced to lower their own prices in order to compete with the discount stores. The discount stores need to improve their images by overcoming the stigma associated with being discount stores in order for them to remain competitive. One method for improving their image is by creating a more attractive showroom.

Improving their lighting systems is one way for the discount stores, factories and warehouses to help solve their respective problems. This can be a great expense, however. Light louvering, baffling and diffusing systems which fit their original strip lighting fixtures may not be available. If they are available, they may be heavy, expensive and time consuming to install. If they are not available, a whole new lighting system may need to be installed. Both of these alternatives may require shut down time which adds greatly to the expense.

DISCLOSURE OF THE INVENTION

A louver system embodying the present invention is of simple design which may be readily installed on any strip lighting fixture having its light tubes exposed. A major advantage of such louver systems is they may be quickly installed without special tools or major adjustments to the lighting fixtures. In fact, in most installations, no adjustments to the light fixtures are required.

The louver system can easily be manufactured to fit strip lighting fixtures of any length or width.

Another major advantage of the louver system is its lightweight. The lower system addes very little weight to existing ceiling and roof loads.

The louver system includes a series of louver assemblies arranged in an end-to-end relationship. Each assembly is mounted on and suspended from an associated fixture. Each assembly includes appropriately sized brackets which are placed over the lighting fixtures. Each bracket has a tab or pair of tabs. At least one of these tabs is screwed to its associated fixture by a self-tapping screw.

End portions of the brackets carry longerons of a louver assembly. Each longeron parallels its associated lighting fixture lengthwise along a side of the fixture. A set of louvers is attached to and between opposite longerons. The louvers hang below and wrap up along the side of the lighting fixture when in use. A stringer fin runs transverse to the louvers through their midsections and holds them in proper spacial relationship. A pair of side baffles runs transverse to the louvers along the inside corners of the louvers and helps obscure the lamps from the view of an observer.

The end portions of each bracket are shaped differently. One end portion of a bracket is shaped as a J while the other is basically a flat L. This allows the longeron on the L side to be swung away from the lighting fixture and hang below the J side thereby supporting the louver assembly by the longeron on the J side. This allows the lighting fixture to be serviced quickly and easily without dismantling or removing the louver assembly.

The brackets can also be shaped to mount directly to the lighting fixture. In such an embodiment, the end support portions are mounted with mounting structure incorporated on the side of the lighting fixture.

The louver assembly softens the light emitted from the lighting fixture to create a more attractive and appealing environment. The entire louver assembly and lighting fixture provide the appearance of a single unit.

Flat finished end louvers are attached at the end louver assemblies of a strip. The end louvers and the louver sets cooperate to contribute to the single unit appearance and to "shield" an observer from the lighting lamps.

With the present invention louver assemblies are placed end to end and appear to be a continuous system. The brackets automatically align the louver assemblies end to end so that no adjustments are required to achieve the continuous appearance.

Accordingly the objects of the invention are to provide a novel universal fit louver system for use with strip lighting fixtures for baffling and diffusing the light emitted from the fixtures and a method of baffling such fixtures.

These and other objects of the invention will be better understood from the following description of the invention shown in the accompanying drawings.

BRIEF DESCRIPTION OF THE DRAWINGS

FIG. 11 is a plan view of a bracket.

FIG. 12 is an end elevational view of a bracket.

FIG. 13 is an enlarged sectional view of a side baffle mounted on a louver.

DESCRIPTION OF THE PREFERRED EMBODIMENT

Figure 1:
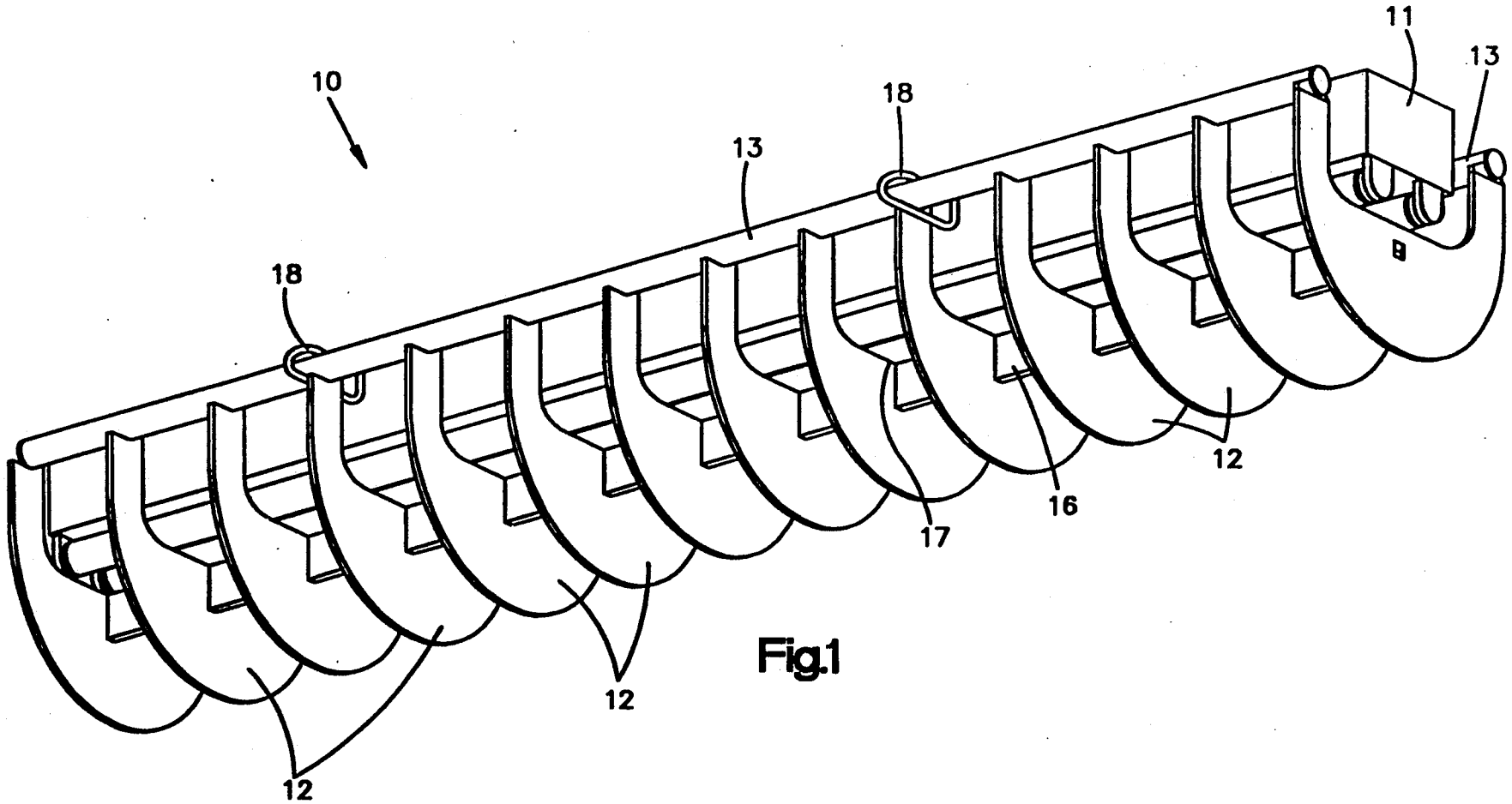
FIG. 1 is a perspective view of a louver assembly shown without side baffles in use with a strip lighting fixture.

A louver assembly 10 is shown in FIG. 1. The assembly 10 is mounted on a strip lighting fixture 11. The system includes a set of louvers 12 connected to two longerons. Two side baffles 14 are connected to the louvers 12, running transverse to them on their inner corners at 15 (illustrated in FIGS. 2, 3, 13 and 18). A stringer fin 16 runs transverse to the louvers 12 at their inner centers 17. Two brackets 18 support the longerons 13 and thereby support the entire assembly 10 from the fixture 11. The louver assembly 10 is designed to be mounted on fixtures which are end to end in a series or can be mounted on isolated, individual fixtures.

Turning to FIGS. 2, 3, 11, 12, a bracket 18 is illustrated. A longeron support arm portion 25 is shaped like a flat L. The arm portion 25 is connected to a central portion 26 which is shaped like an inverted, squared U. The central portion 26 is shaped to fit over the lighting fixture 11. A second longeron support arm portion 27 is connected to the central portion 26. The support arm portion 27 is shaped like a flat J. An end section 28 of the support arm portion 27 projects upwardly in a C shape and is a safety feature to prevent accidental removal of an associated longeron 13.

Tabs 29, 30 are connected as shown to their respective side sections 31, 32 of the central portion 26. At least tab 29 receives a fastener in the form of a self-tapping screw 33 through an associated aperture to fasten the bracket 18 to the lighting fixture 11. Each tab 29 is fastened to the fixture to prevent its bracket 18 from moving out of its intended position when its supported louver assembly 10 is in its service access position of FIG. 3.

Figure 18:
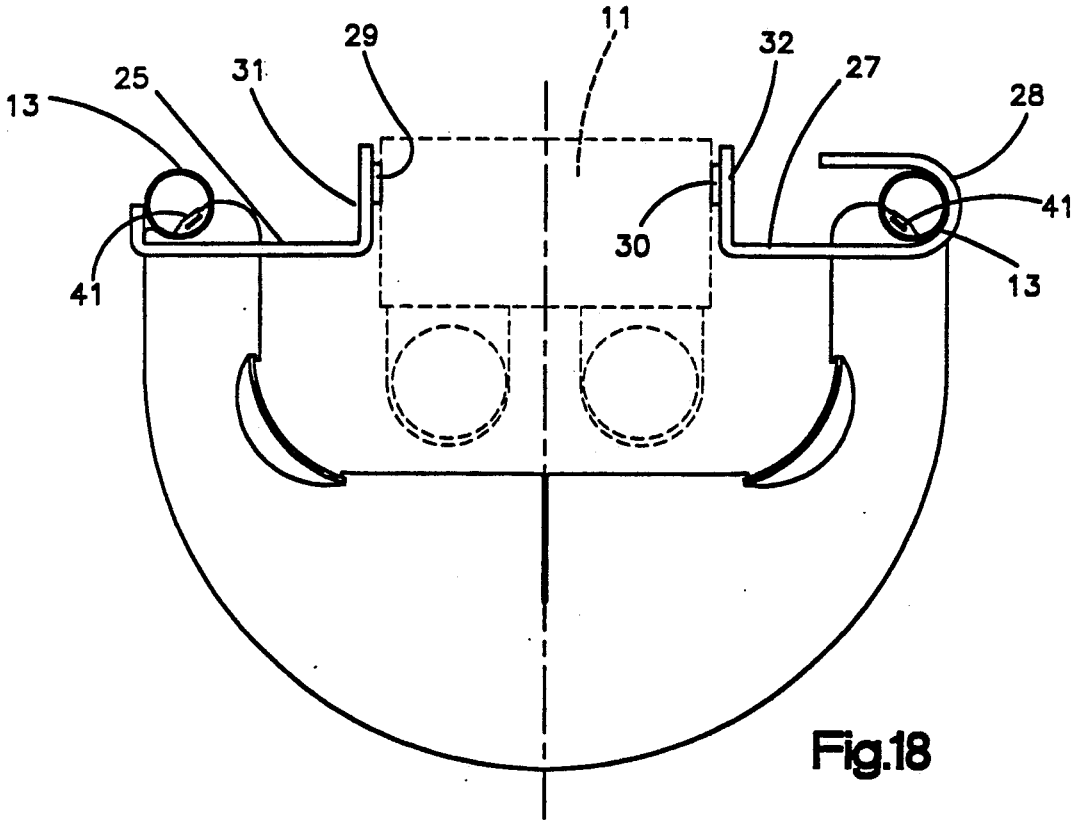
FIG. 18 is an end elevational view of a louver assembly in use with a strip lighting fixture without the central portion of a bracket.

In an alternative embodiment shown in FIG. 18, the lighting fixture 11 incorporates mounting structure which utilizes side sections 31, 32 and tabs 29, 30 as a part of the lighting fixture thereby eliminating the bracket central portion 26.

Figure 16:
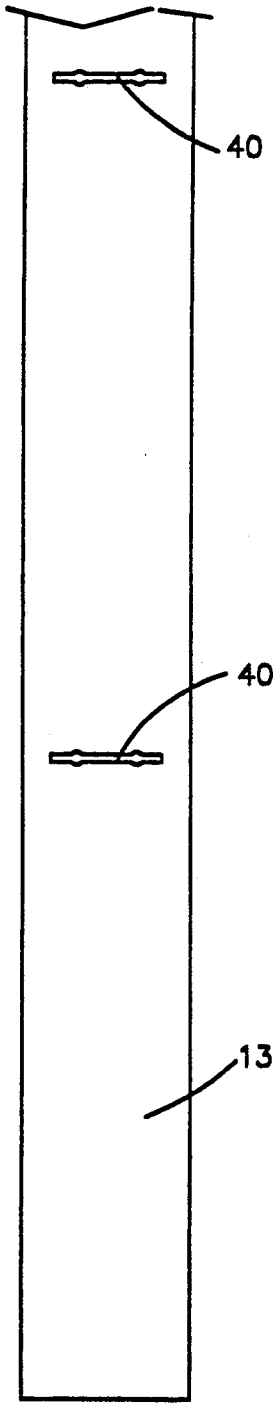
FIG. 16 is an elevational view of an end portion of a longeron.

Turning to FIG. 16, a section of a longeron 13 is illustrated. The longeron is hollow and has numerous slots 40. The number of slots 40 corresponds to the number of louvers 12 within the assembly 10. Two longerons 13 are utilized in an assembly 10, running parallel to and alongside the lighting fixture 11. The longerons are supported by the support arm portions 25, 27 of the brackets 18.

Figure 2:
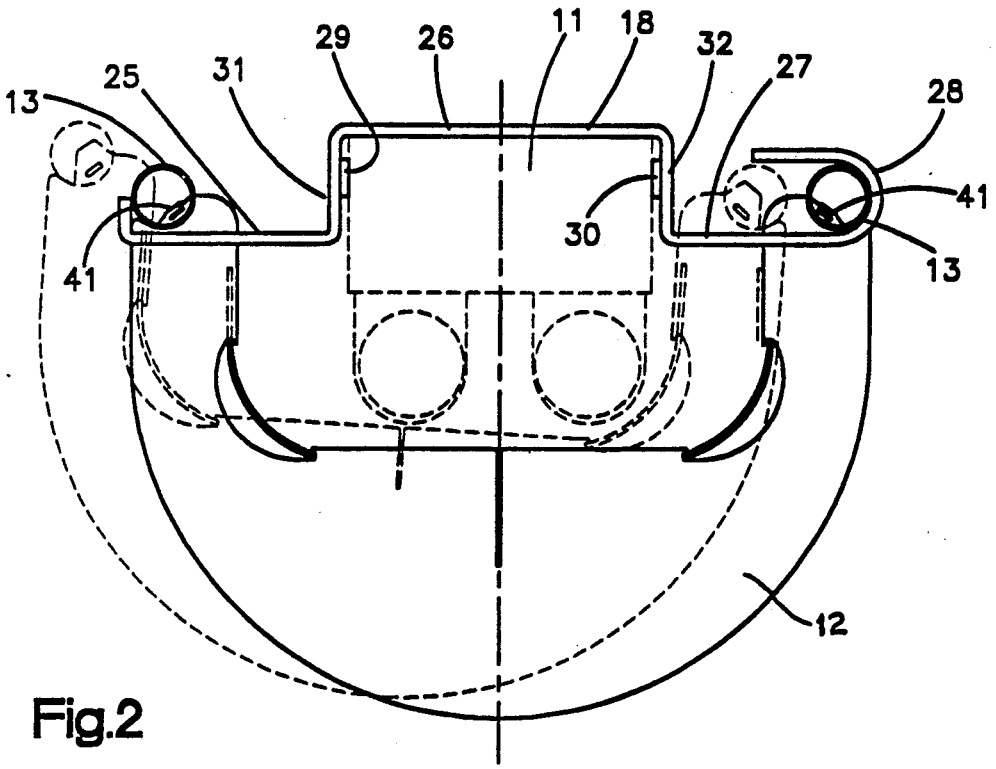
FIG. 2 is an end elevational view of a louver assembly in use with a strip lighting fixture illustrating in phantom the assembly shifted for removal from one end of the bracket.
Figure 3:
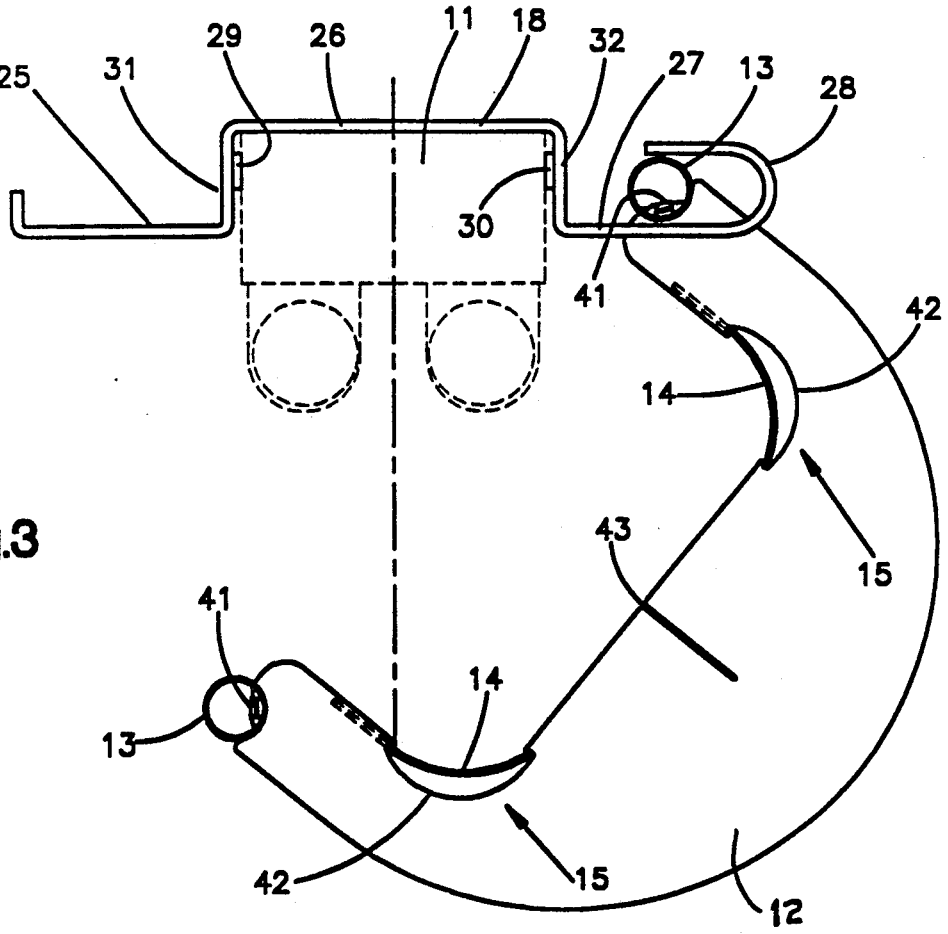
FIG. 3 is an end elevational view of a louver assembly in its open position in use with a strip lighting fixture.
Figure 4:
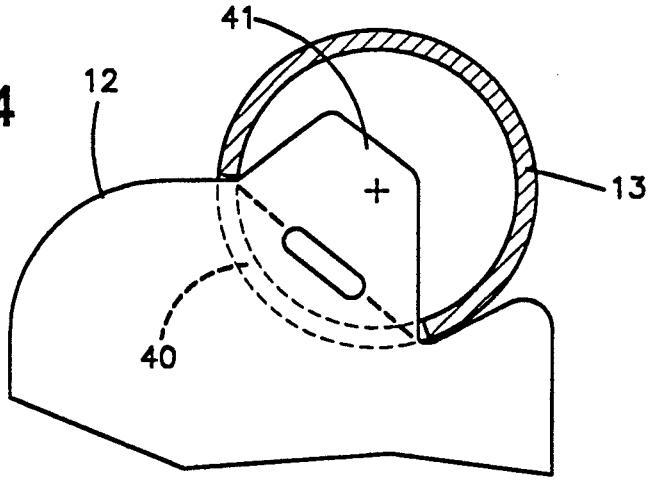
FIG. 4 is an enlarged sectional view of a longeron with a louver end portion inserted into the longeron.
Figure 5:
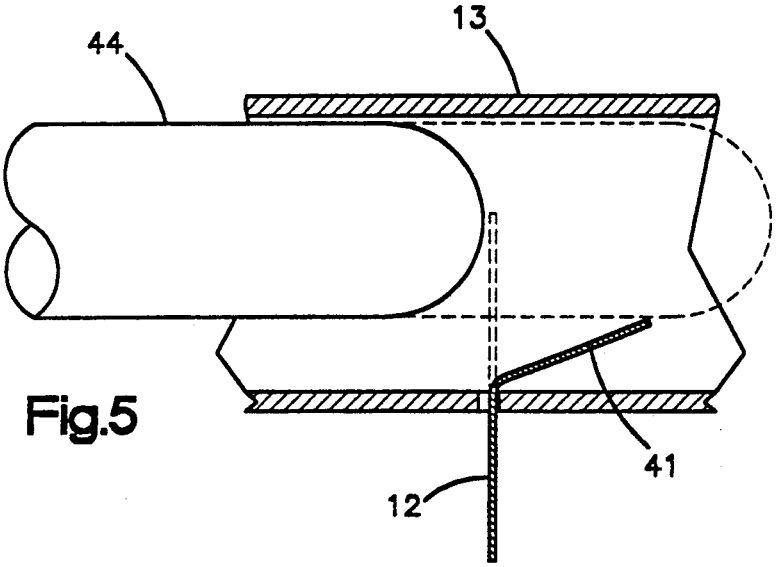
FIG. 5 is an enlarged cross sectional view of a longeron illustrating the method of bending the louver end portion.

A louver 12 is illustrated in FIGS. 2 and 3. The top of the louver 12 has end portions 41 each which is inserted into a corresponding slot 40 of a respective longeron 13 as illustrated in FIG. 4. The end portions 41 are bent by a ram rod 44 which is inserted in the longerons 13 as shown in FIG. 5. This affixes the louvers 12 to the longeron 13. The louvers therefore connect the two longerons 13 as illustrated in the various FIGS.

Figure 15:
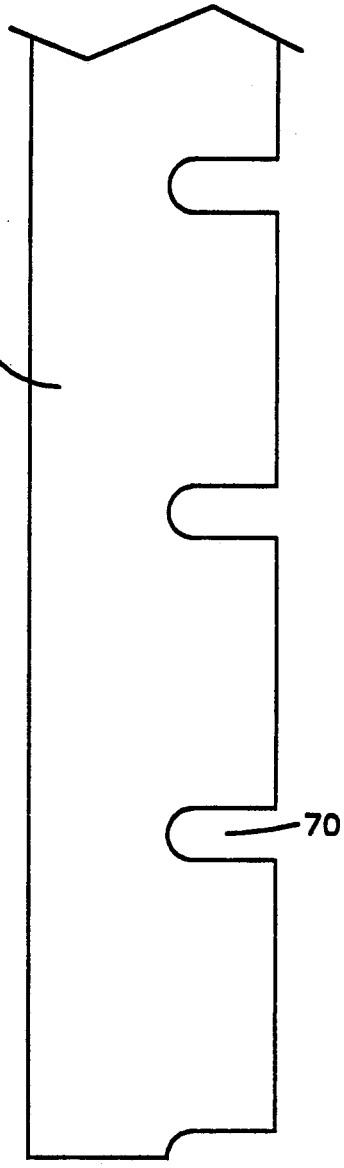
FIG. 15 is an elevational view of an end portion of a side baffle.
Figure 17:
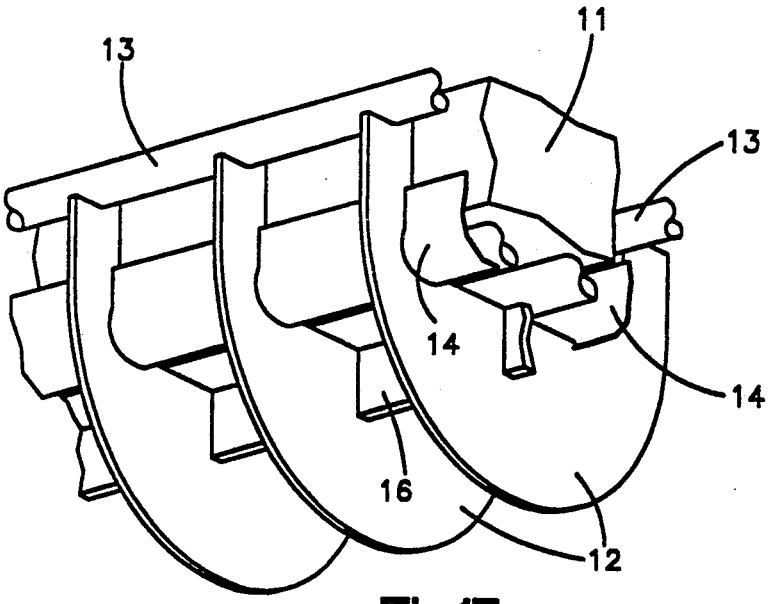
FIG. 17 is a sectional view of a louver assembly shown with side baffles in use with a strip lighting fixture.

The louvers have slots 42 for receiving the side baffles 14. A section of a side baffle is illustrated in FIG. 15 and is also illustrated in use with a louver assembly 10 in FIG. 17.

Figure 14:
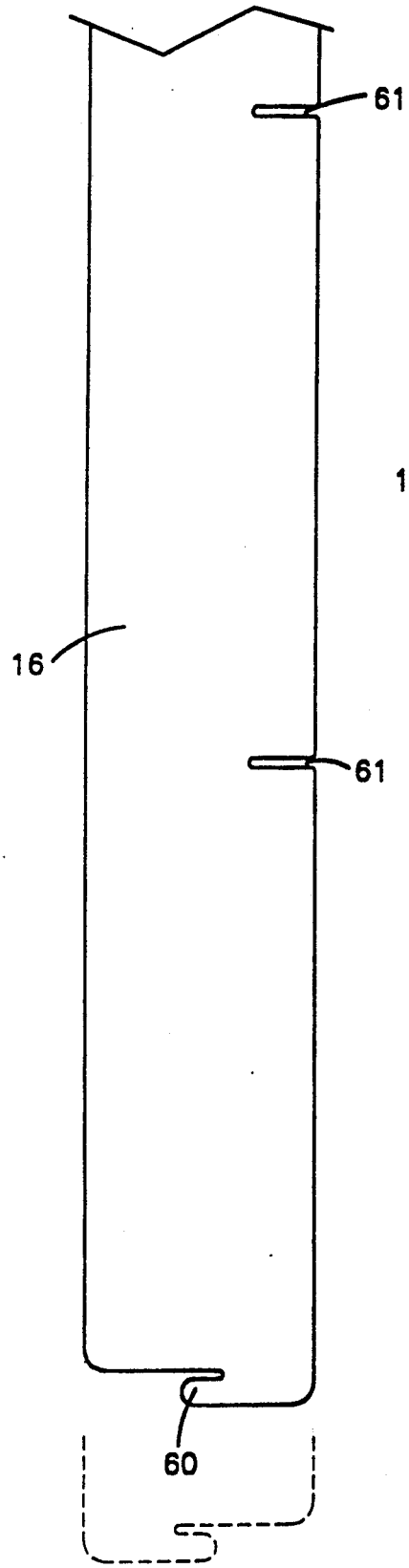
FIG. 14 is an elevational view of an end portion of a stringer fin.

The louvers 12 also have slots 43 for receiving a stringer fin 16. A section of a stringer fin 16 is illustrated in FIG. 14.

Figure 6:
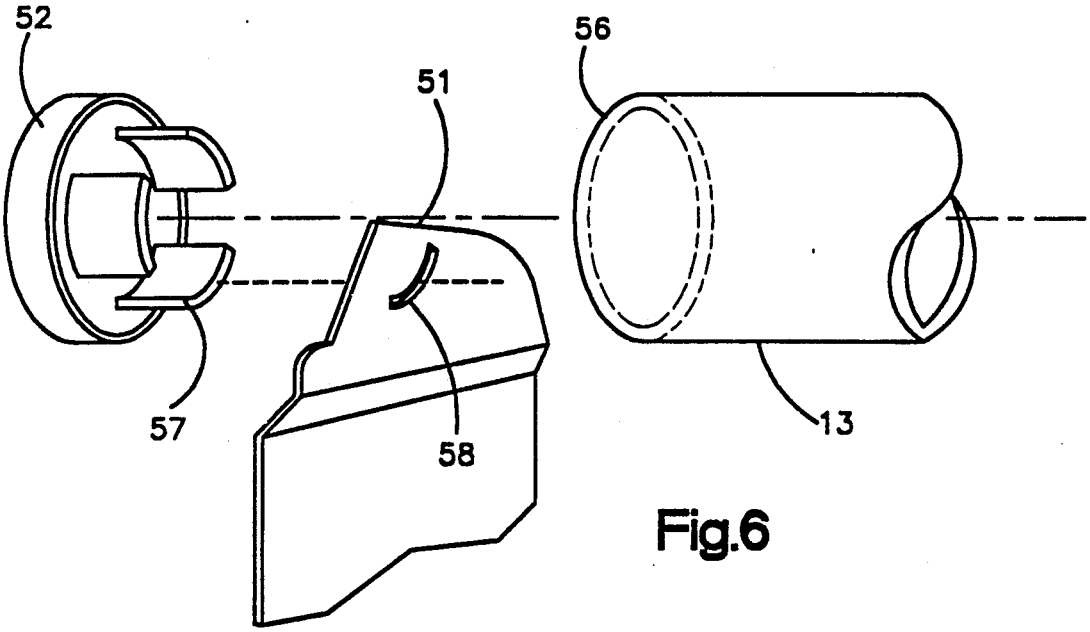
FIG. 6 is an enlarged exploded view illustrating an end cap mounting an end portion of a formed end louver to a longeron.
Figure 9:
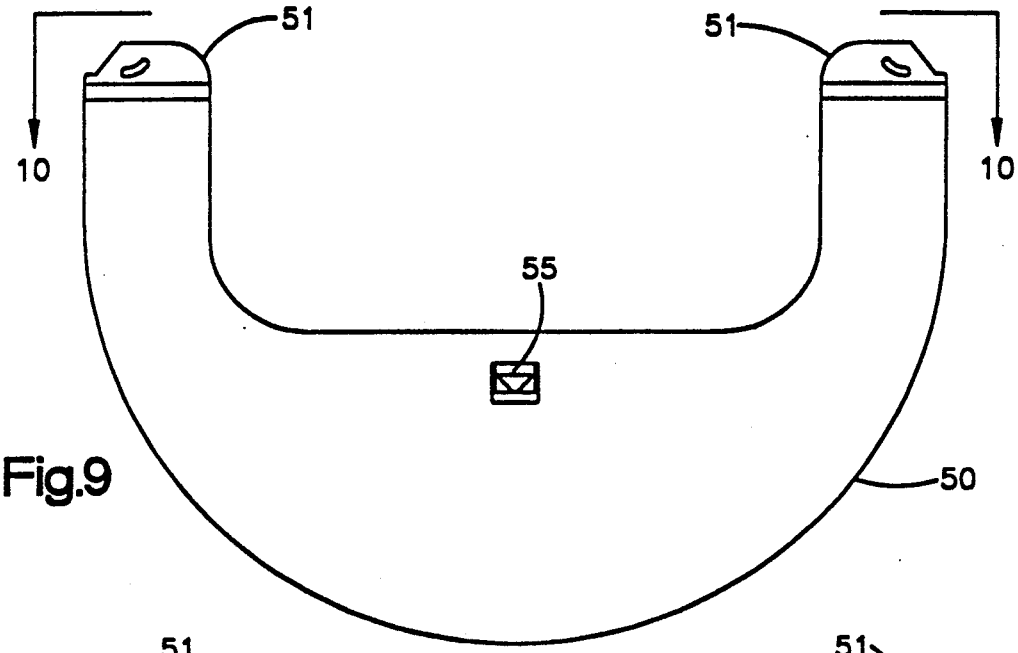
FIG. 9 is an elevational view of a formed end louver.
Figure 10:
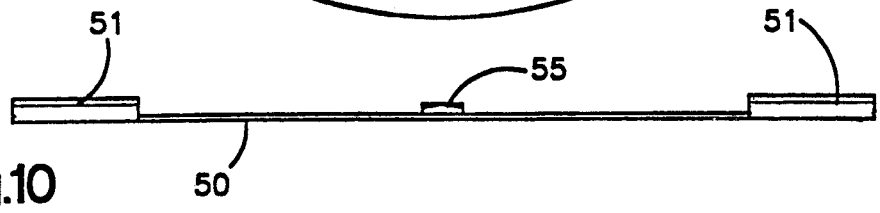
FIG. 10 is a plan view of a formed end louver as seen from the plane indicated by the line 10—10 of FIG. 9.

A formed end louver 50 is illustrated in FIGS. 9 and 10. The formed end louver 50 has end portions 51 which are laid against an end portion 56 of a corresponding longeron 13. An end cap 52 is then inserted into the corresponding longeron 13 with a portion 57 of the end cap passing through a slot 58 located in the louver end portion 51 as illustrated in FIG. 6. This attaches the formed end louver 50 to the corresponding longeron 13. The formed end louver 50 includes a slot 55 for receiving a stringer fin end portion 60.

The end portions 51 can also be bent in order to attach the formed end louver 50 to the corresponding longeron 13. In such an embodiment, end portion 51 is shaped as end portion 41 and used with a longeron slot 40. The end cap 52 then provides only a cosmetic function. In this alternative embodiment, the stringer fin end portion 60 is shaped as shown in phantom in FIG. 14 and the slot 55 is turned 180°.

Figure 7:
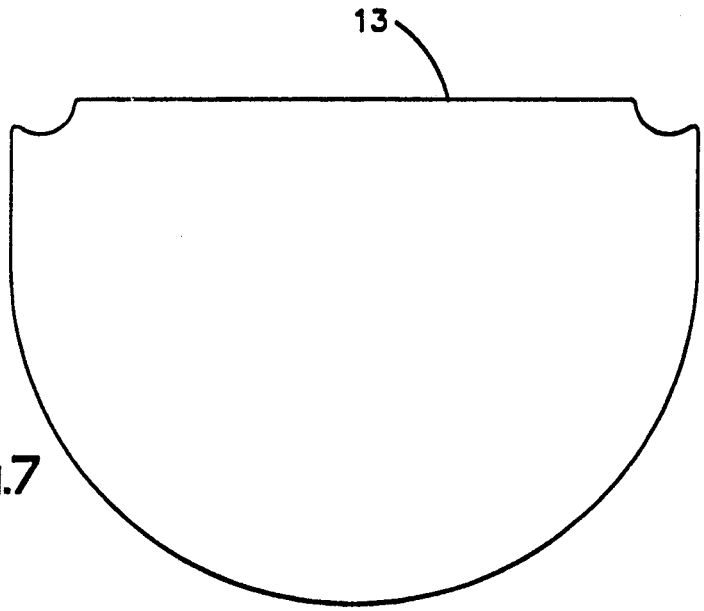
FIG. 7 is an elevational view of a flat finished end louver.
Figure 8:
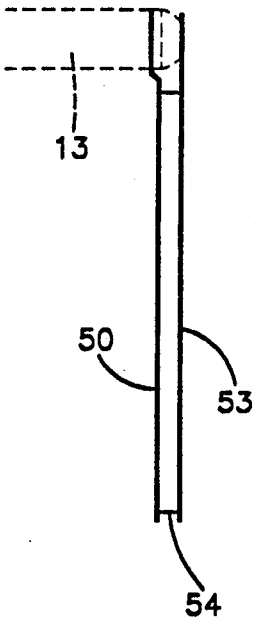
FIG. 8 is a side elevational view of a flat finished end louver mounted to a formed end louver.

A flat finished end louver 53 is illustrated in FIG. 7. This louver is attached to an adjacent formed end louver 50 using a mounting structure. In the preferred embodiment, double-sided foam tape 54 is utilized as illustrated in FIG. 8. The flat finished end louver can also be attached with mechanical fasteners in an alternative embodiment. Flat finished end louvers 53 finish off the louver assembly or the louver system depending on whether they are added to each end of a louver assembly 10 or only to the outer end of an end assembly 10 of a continuous end to end series of louver assemblies 10.

A section of a stringer fin 16 is illustrated in FIG. 14. The fin 16 is basically a flat, rectangular piece and has slots 61 for receiving corresponding louver slots 43. The fin also has an end portion 60 for being received into a corresponding slot 55 on a formed end louver 50.

A section of a side baffle 14 is illustrated in FIG. 15. The side baffle is basically a rectangular piece that is transversely curved, and has slots 70 each of which is received in a corresponding one of the louver slots 42.

The side baffles 14 are made of translucent or clear lensed plastic and therefore flex into place. The longerons 13 may also be shaped to act as side baffles or reflectors, or side baffles may be eliminated altogether if so desired.

Turning to FIGS. 2 & 3, the ease with which the lighting fixture 11 may be accessed for service is illustrated. FIG. 2 shows the louver assembly 10 in its normal mounted position with the lighting fixture 11 shown in phantom. FIG. 2 also illustrates in phantom the louver assembly 10 shifted for being removed from the L shaped support arm portion 25. FIG. 3 illustrates the louver assembly 10 in its open state thereby allowing access to the fixture 11, shown in phantom, without dismantling or removing the louver assembly 10. As can be seen in the drawings, the louver assemblies can not be removed from the brackets without being lifted first. This is an important safety feature built into the brackets for situations such as earthquakes and other potentially dangerous events.

While a preferred embodiment of the invention has been illustrated and described in detail, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

I claim:

1. For use with a strip lighting fixture, an improved louver assembly, comprising:

a) at least two brackets, each having a central portion in the shape of an inverted, squared U;

b) the brackets each including a pair of spaced louver support arm portions connected to and projecting laterally from opposite sides of the central portion;

c) each bracket further including a spaced pair of upright end portions respectively connected to and projecting upwardly from the support arm portions at locations spaced from the central portion, one end portion projecting upwardly in a C shape such that the one end portion and the connected support portion are J shaped thereby partially closing the corresponding support arm portion;

d) at least one fastener attachable to at least one downward portion of one of the bracket central portions to secure the one bracket to the fixture;

e) a spaced pair of longerons each adapted for support by the arm portions such that the longerons when in use are supported on opposite sides of an associated fixture;

f) a plurality of louvers at least some of which are connected to both longerons to maintain the longerons in a predetermined spaced relationship, the louvers having light intercepting surfaces disposed laterally of such associated fixture when in use; and, g) two formed end louvers, both formed end louvers having two end portions, each end portion being connected to a corresponding longeron end portion.

2. The assembly of claim 1 wherein each bracket has at least one stabilizer tab projecting laterally from the side of its central portion and the fastener is connectable to the and said fixture opposite the J portion of the bracket.

3. An improved louver assembly as described in claim 1 further including at least two flat finished end louvers.

4. An improve a louver assembly as described in claim 3 wherein the flat finished end louvers are attached to an adjacent formed end louver with foam tape.

5. An improved louver assembly as described in claim 1, wherein the longerons are shaped to act as longitudinal reflectors.

6. An improved louver assembly as described in claim 1 further including at least one separate longitudinal side baffle connected to the louvers.

7. An improved louver assembly as described in claim 1, wherein a plurality of end caps are provided and each end portion of each longeron carries an associated one of the caps.

8. The assembly of claim 7 wherein said two formed end louver end portions are attached to the longeron end portions with an associated end cap.

9. The assembly of claim 1 wherein at least one slotted stringer fit is provided, each slot receiving a corresponding one of the plurality of louvers, the fin running transverse to the louvers and having its end portions connected to a corresponding formed end louver.

10. For use with a strip lighting fixture, an improved louver assembly, comprising:

a) at least two pairs of spaced longeron support arm portions connected to and projecting laterally from opposite sides of the lighting fixture;

b) each pair of spaced longeron support arm portions further including a spaced pair of upright end portions respectively connected to and projecting upwardly from the support arm portions at locations spaced from the lighting fixture, one end portion projecting upwardly in a C shape such that the one end portion and the connected support portion are J shaped thereby partially closing the corresponding support arm portion;

c) a spaced pair of longerons each adapted for support by the arm portions such that the longerons when in use are supported on opposite sides of an associated fixture;

d) a plurality of louvers at least some of which are connected to both longerons to maintain the longerons in a predetermined spaced relationship, the louvers having light intercepting surfaces disposed laterally of such associated fixture when in use;

e) two formed end louvers, both formed end louvers having two end portions, each end portion being connected to a corresponding longeron end portion;

f) at least one separate longitudinal side baffle connected to the louvers;

g) at least one slotted stringer fin, each slot receiving a corresponding one of the plurality of louvers, the fin running transverse to the louvers and having its end portions connected to a corresponding formed end louver.

11. For use with a louver assembly for strip lighting fixtures, a bracket, comprising:

a) a central portion in the shape of an inverted, squared U;

b) a pair of spaced louver support arm portions projecting laterally from opposite sides of the central portion;

c) a spaced pair of upright end portions respectively connected to and projecting upwardly from the support arm portions at locations spaced from the central portion, one end portion projecting upwardly in a C shape such that the one end portion and the connected support arm portion are J shaped thereby partially closing the corresponding support arm portion; and, d) at least one stabilizer tab projecting laterally from the side of the central portion and adapted to be connected to an associated lighting fixture when in use.

12. In combination with an elongate strip lighting fixture including a housing generally in the shape of a rectangular solid, a louver assembly comprising:

a) a pair of brackets, each bracket including:

i) spaced depending side parts respectively outwardly of and near sides of the housing;

ii) a tab projecting laterally from one of the parts and secured to this fixture;

iii) a spaced pair of arms respectively connected to the side parts and projecting laterally and outwardly from the housing; and, iv) a spaced pair of end parts respectively connected to the arms at locations spaced from the side parts; one of end parts being C shaped such that the one end part and its connected arm provide a J shaped support and the other end part and the other arm provide a spaced support;

b) a spaced pair of longerons, one of the longerons being supported on the J shaped supports and the other on the spaced supports;

c) a plurality of spaced louvers secured to the longerons in depending relationship, each of the louvers being disposed laterally of the fixture and being of a lateral dimension greater than the fixture such that light radiating from the fixture is reflected and diffused by the louvers; and, d) a stringer fin interconnecting lower portions of the louvers, the stringer fin maintaining a predetermined spaced relationship among the louvers.

13. The combination of claim 12 wherein each bracket further includes a central portion located between the side parts with a central part engaging the top of the housing such that the central portion is generally in the shape of an inverted squared U.

14. The combination of claim 12 wherein the longerons are tubular and end caps close end portions of the longerons.

15. The combination of claim 12 wherein the tabs project from side parts.

16. The combination of claim 12 wherein each of the side parts carries a projecting tab.

17. The combination of claim 12 further including at least one flat finished end louver with a mounting structure attaching it to the louver assembly.

18. A method of baffling a fluorescent fixture comprising:

a) positioning brackets on a housing of the fixture thereby providing two pairs of laterally extending arms with one pair projecting laterally from one side of the housing and the other pair projecting laterally from the other side of the housing;

b) securing the brackets to the fixture;

c) mounting a first longeron of a louver assembly on the first pair of arms to suspend the assembly from the housing, the mounting step including the substep of passing the first longeron over upstanding longeron retention parts of the arms of the first pair and lowering the assembly until the first longeron is supported by support parts of the arms of the first pair;

d) pivoting the assembly about the first longeron while positioning the first longeron first near and then spaced from the housing while concurrently moving a second longeron into supported relationship with the arms of the second pair.

* * * * *

UNITED STATES PATENT AND TRADEMARK OFFICE

CERTIFICATE OF CORRECTION

PATENT NO. : 5,117,342

DATED : May 26, 1992

INVENTOR(S) : John Vlah

It is certified that error appears in the above-identified patent and that said Letters Patent is hereby corrected as shown below:

Column 3, line 42, should read -- longerons 13. Two side baffles 14 are connected to the --

Column 5, line 67, should read -- to the tab and said fixture opposite the J portion of the --

Signed and Sealed this

Nineteenth Day of October, 1993

Bruce Lehman

*Attest:*

BRUCE LEHMAN

*Attesting Officer*

*Commissioner of Patents and Trademarks*